US005271171A

United States Patent [19]

Smith

[11] Patent Number: 5,271,171

[45] Date of Patent: Dec. 21, 1993

[54] COMPRESSIBLE AND EXPANDABLE STRETCHING FRAME WITH ADJUSTABLE CORNER BRACKETS

[76] Inventor: David C. Smith, 1385 Preston Way, Venice, Calif. 90291

[21] Appl. No.: 833,339

[22] Filed: Feb. 10, 1992

[51] Int. Cl.[5] ..... D06C 3/08

[52] U.S. Cl. ..... 38/102.5; 38/102.91; 101/127.1; 160/374.1; 160/392

[58] Field of Search ..... 38/102.1, 102, 102.4, 38/102.5, 102.7, 102.91, 102.9; 101/127.1, 415.1; 160/369, 371, 374.1, 376, 378, 381, 392, 395

[56] References Cited

U.S. PATENT DOCUMENTS

| | | | |
|---|---|---|---|
| 106,332 | 8/1870 | Crocker | 160/374.1 |
| 119,507 | 10/1871 | Crocker et al. | 160/374.1 |
| 1,758,720 | 5/1930 | Sodergren | 160/392 |
| 3,477,574 | 11/1969 | Malfroy | 101/127.1 X |
| 3,482,343 | 12/1969 | Hamu | 38/102.5 |
| 3,601,912 | 8/1971 | Dubbs | 38/102.91 |
| 3,914,887 | 10/1975 | Newman | 38/102.8 |
| 3,949,500 | 4/1976 | Connors | 38/102.5 |
| 3,950,869 | 4/1976 | Samarin | 38/102.91 |
| 4,144,660 | 3/1979 | Lamb | 38/102.5 |
| 4,301,853 | 11/1981 | Vidal | 38/102.5 X |
| 4,430,814 | 2/1984 | Wulc | 38/102.91 |
| 4,430,815 | 2/1984 | Wulc | 38/102.91 |
| 4,452,138 | 6/1984 | Bubley et al. | 101/127.1 |
| 4,525,909 | 7/1985 | Newman | 29/121.1 |
| 4,539,734 | 9/1985 | Messerschmitt | 38/102.91 X |
| 4,635,700 | 1/1987 | Berger | 180/374.1 |
| 4,860,467 | 8/1989 | Larson | 38/102.4 |
| 5,076,162 | 12/1991 | Goin | 101/127.1 |
| 5,136,797 | 8/1992 | Hildebrandt | 38/102.91 |

OTHER PUBLICATIONS

Park Fastener Co., "Fastak Strip", Sep. 26, 1973, both sides.

Sales Brochure, "Diamond Roller-Chase . . . ", Diamond Chase Co., Huntington Beach, Calif., pp. 1-4.

Sales Brochure, "RST Series 'S' & 'T' Frames", IGPI, Grants Pass, Ore., pp. 1-2.

Sales Brochure, "Gain Control with the Newman Roller Frame", Stretch Devices, Inc., Phila, Pa., pp. 1-2, 1983.

Sales Brochure, "Alooma Light . . . ", Expert Products, Westlake Village, Calif. 91362, pp. 1-4.

*Primary Examiner*—Clifford D. Crowder
*Assistant Examiner*—Isreal Izaguirre
*Attorney, Agent, or Firm*—Andrew Jordan

[57] ABSTRACT

A stretching frame for a fabric material provides for spring mounting of the four frame sides. The frame sides are tubular. At each corner of the frame is a bracket which slides within the adjacent frame tubes. A tensioning device at each end of each of the frame sides may be set to provide an appropriate urging force by tensioning a spring. Each side has a slot for insertion of the fabric edge and a locking rod to hold the fabric edge in place within the slot. The frame may be used for a range of fabric sizes by changing spring length or characteristic used for tension development. In use as a silk-screen, the side forces applied to the fabric during the printing stroke is taken up by the springs such that a minimal amount of distortion is experienced by the fabric and stencil thereon.

7 Claims, 3 Drawing Sheets 160
40
140
120
150
5

10
6
30
5

20
10
60
12
50
80
90
100
110
4
4

100
80

COMPRESSIBLE AND EXPANDABLE STRETCHING FRAME WITH ADJUSTABLE CORNER BRACKETS

BACKGROUND OF THE INVENTION

1. Field of the Invention

The invention relates to fabric stretchers. More particularly, this invention relates to an apparatus for stretching screen fabric for use in silk screen processing or the like.

2. Description of the Related Art

Stretching frames are used for a wide variety of applications. One prevalent use for such frames is in the field of graphic arts. In the medium of oil painting, the canvas must be stretched into a taut plane so that paint may be applied onto a firm and stationary surface. Frequently the frame used for such art is made of wood and the canvas is attached to one side and then pulled across to the opposite side where it is anchored. Such frames may be fashioned so that a wedge may be driven into each of the corners of the frame to provide tension for tightening the canvas.

Silk screens may be used for transfer of inks for the creation of an artwork or in the printing industry. Screen mesh in current use in the screen print industry is manufactured from polyester, or in some cases stainless steel fabrics. The polyester or stainless steel materials are typically supported by and tensioned between opposing sides of a four sided frame. Screen mesh, when stretched into a taut plane, provides the foundation for a stencil. Printing ink can then be forced through the open areas of the stencil by means of a flexible blade or squeegee, creating an image in the shape of the stencil on a workpiece positioned beneath the screen.

High quality, high definition screen printing depends on several factors if optimum results are to be achieved. The screen must be maintained at the recommended working tension throughout the print run so that the pattern is transferred with accuracy. Tension variation across the screen mesh must be kept to a minimum.

A specific and dimensionally constant "off contact" distance must be maintained between the screen mesh and the workpiece to minimize ink build up on the underside of the screen and to prevent rubbing contact between screen and workpiece. During the printing stroke the squeegee blade deflects the fabric downwards forcing it into direct contact with the workpiece during its passage across the screen. This deflection causes the fabric to be stretched from its undisturbed condition. The constant cycle of stretching and "snapping back" accelerates the deterioration of both screen and stencil. Additionally, as the screen mesh undergoes these distorting forces during the print stroke, the stencil on the screen may also be distorted, especially if the off contact is high. This causes a slightly distorted image to be reproduced on the workpiece.

In order to tension the fabric on a tubular alloy frame, the frame tubes must be rotated in opposition to each other with the mesh locked into the frame tubes. The resulting rotational moment often causes the frame to distort slightly in the horizontal plane when tensioned. This distortion causes the off contact distance between screen and workpiece to vary across the print area with a consequent reduction in print quality. The same applies to wood frames where the frame bars tend to warp in service due to changes in temperature and humidity. A sliding method of providing screen tension will ensure that the screen mesh remain in the horizontal plane across its entire surface because of the absence of residual twisting forces.

Popular methods of loading the fabric behind the frames' locking strips introduces the probability of tension variations. This occurs because the strip is forced along a narrow channel along the length of the frame bar with the fabric trapped beneath it in the slot. The mesh may roll up ahead of the leading edge of the strip causing loose pockets of fabric to develop, with consequent tension variations occurring in the fully tensioned screen. Another problem occurs when the screen is held at discrete places on the frame, whereby the fabric of the screen is not stretched uniformly all along the edge of each side of the frame, again causing tension variations.

Screen frames currently available do not allow the mesh and stencil to be easily removed and reinstalled on the frame. Consequently screens must be stored mounted in their frames between print runs. Removal of the mesh and accurate reinstallation for later use is a major improvement over current technology since the cost of frames is high and the reuse of screens is quite common. Additionally, storage of only the screen mesh uses a small fraction of the space required for storing a complete screen and frame assembly.

Currently known frame structures and framing methods, including those available for commercial silk-screen processing suffer from one or more of the foregoing drawbacks. The presently disclosed invention teaches a frame that overcomes the drawbacks of the prior art.

SUMMARY OF THE INVENTION

The invention is a stretching frame for a fabric such as silk screen processing fabric, canvas or any other roll goods that can be stretched into a taut condition in a plane. A Disclosure Document #267428 was filed with the Patent & Trademark Office on Nov. 15, 1990 and shows details pertaining to the invention. The preferred mode provides a frame constructed of two pairs of straight, open ended tubes, each pair of tubes forming the alternate opposing sides of a rectangular stretching frame. It is also possible to construct a three, five or even larger polygon shaped frame for stretching a non-rectangular fabric. Along the inside edge of each tube is a means for the attachment of one edge of the fabric, so that the fabric is supported on all sides within the frame. Corner brackets interconnect the adjacent open ends of the tubes so that one bracket is used in each of the four corners of the rectangular frame. The brackets have two mutually perpendicular tube insertion means, each one being slidably movable within one of the open ends of a frame tube and capable of accommodating varying degrees of insertion. Each insertion means has a means for tensioning, such that the tensioning means can be caused to urge the insertion means to withdraw from the frame tube along the tube axis. The open ends of adjacent frame tubes are each interconnected by one corner bracket such that the four frame tubes and the four corner brackets complete the rectangular stretching frame. Opposite edges of the fabric are attached to opposing pairs of frame tubes, the fabric being stretched between the two pairs of parallel frame tubes as the insertion means are withdrawn, so that as the insertion means is urged to withdraw from each of the open ends of the frame tubes the fabric is caused to be placed into tension. Threaded bolts, mechanical springs, pneumatic, hydraulic or other means may be employed in generating the forces for withdrawing the insertion means.

The fabric edge is secured at the frame tube by a slot or groove fixed along the side of the tube. A locking rod drops directly into the locking slot, capturing an edge of the fabric, which is caused to lay inside the slot and is held therein by the locking rod. The rod is shaped to be held under one of the lips of the slot so that tension applied to the fabric causes the fabric to be more tightly captured within the slot by the locking rod. The stretching frame is easy to use, the fabric edges being simply inserted and locked in the frame tube slots by the locking rods, and tension being adjusted by turning the externally threaded nuts in each of the insertion means.

It is an object of the invention to provide a fabric stretching frame which is inexpensive to produce, the frame tubes being sections of an extruded shape, the other elements of construction being simple molded or machined parts. Low friction materials or coatings may be applied to contact surfaces to minimize friction between the sliding components.

It is an object of the invention to provide a frame which permits rapid changeover from one screen to another in the frame and for subsequent reinstallation of screens by the simple expedient of bonding the locking rods to the fabric and removing and replacing the rods and fabric as a unit. The rods, being bonded to the fabric, provide an excellent means for accurately relocating the fabric in the frame when next required.

It is an object of the invention to provide a novel mechanism for setting the fabric into a dynamic state of tension whereby forces experienced by the fabric in use as a screen or other use, are transferred to the tensioning springs at each corner of the frame. Therefore the spring tension in each of the springs can be preset to accommodate acceptable force levels in a given fabric and especially provide a uniform distribution of tension in the fabric across the entire screen. The coil springs compress and expand in response to deflection forces applied to the fabric, thereby minimizing distortion of the printed image.

Other advantages of the presently disclosed invention will be disclosed in the detailed description of the invention.

BRIEF DESCRIPTION OF THE DRAWINGS

The accompanying drawings illustrate the invention. In such drawings.

DESCRIPTION OF THE PREFERRED EMBODIMENT

Figures 1, 2:
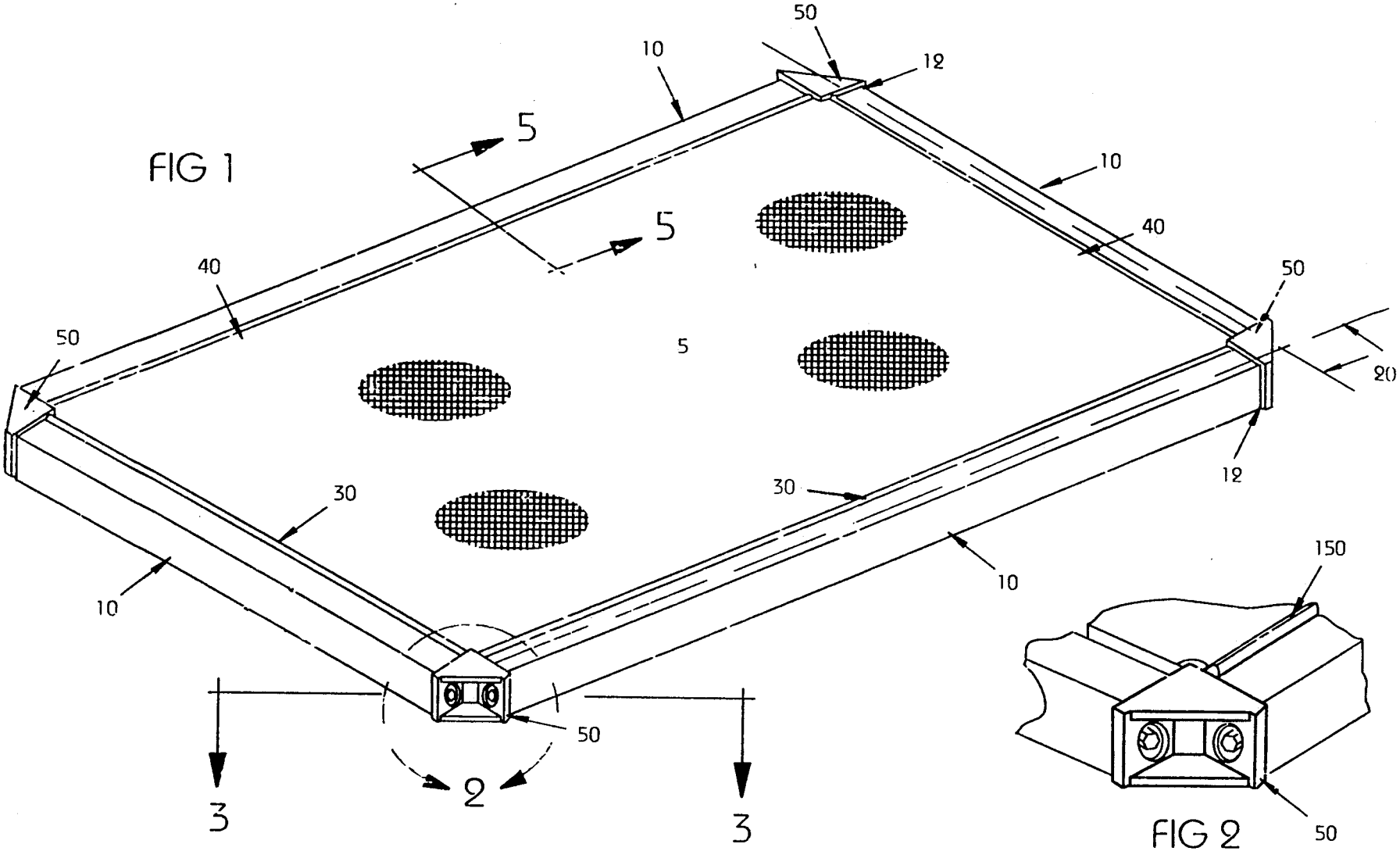
FIG. 1 is a perspective illustration of the invention, illustrating a screen held within the stretching frame in normal use of the invention.
FIG. 2 is an enlarged view of one of the corners of the frame along circle 2 of FIG. 1.

FIG. 1 shows the invention; a stretching frame for a fabric 5. The frame has two pairs of straight frame tubes 10, each of the tubes having open ends 12. The frame tubes 10 form the sides of the rectangular stretching frame, the frame tubes 10 having a tube axis 20 and a means for attachment 30 of an edge of the fabric 5, the fabric edge 40 lying parallel to the tube axis 20.

Figures 3, 4, 5, 6:
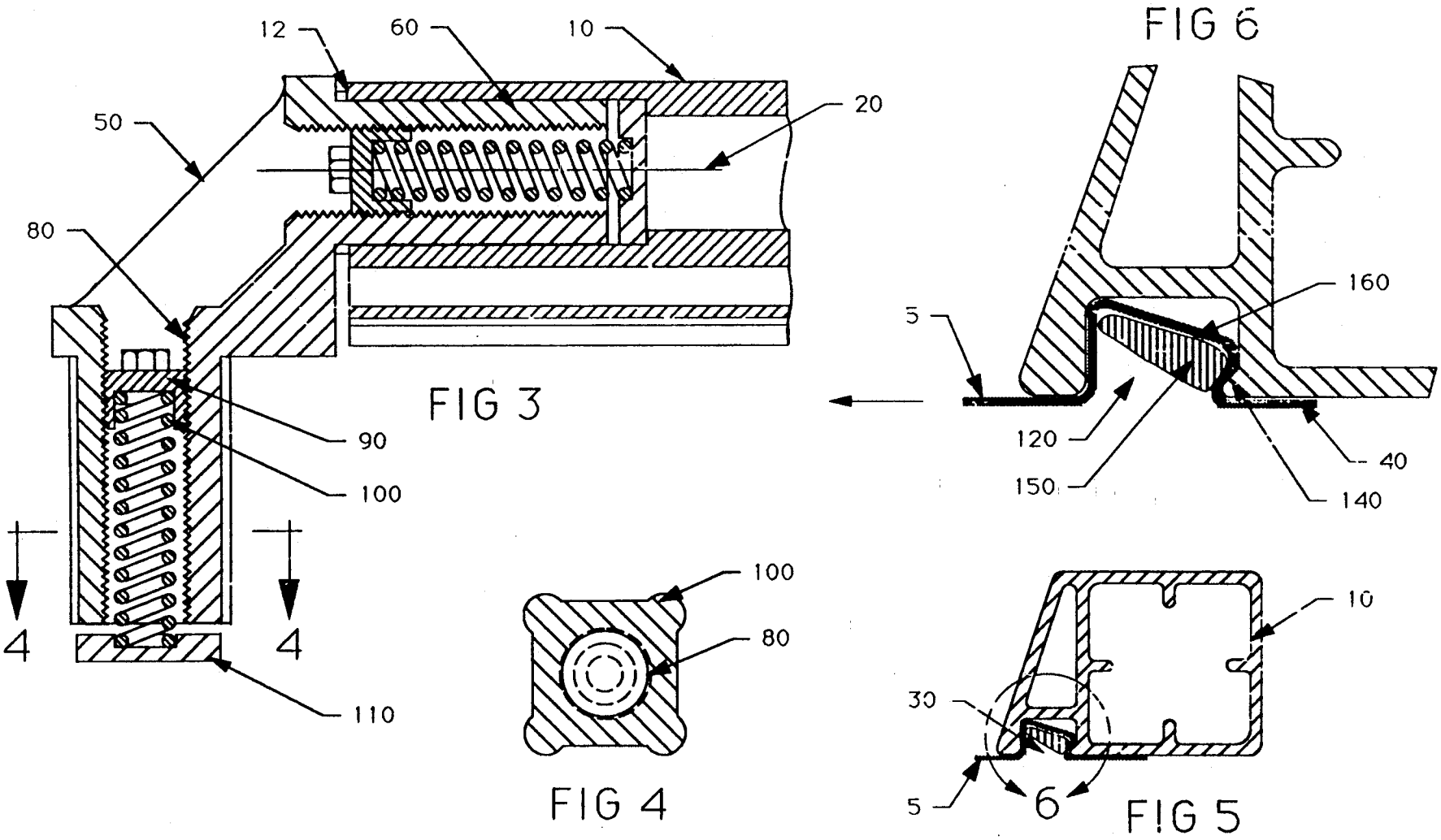
FIG. 3 is a cross sectional view of one of the corners of the frame illustrating details of the insertion means and the tensioning means along line 3—3 of FIG. 1.
FIG. 4 is a cross sectional view of one of the tube insertion means along line 4—4 of FIG. 3.
FIG. 5 is a cross-sectional view of one of the tubes along line 5—5 of FIG. 1.
FIG. 6 is an enlarged view of how the fabric is secured by the locking rod along circle 6 of FIG. 5.

Four rigid corner brackets 50 are fitted into the open tube ends 12 at each of the corners of the frame. The brackets 50 terminate in a pair of mutually orthogonal, tube insertion means 60 (FIG. 3). Each one of the tube insertion means 60 is slidably movable along the tube axis 20 within one of the open ends 12 of the frame tubes 10. Each insertion means 60 has an axially aligned threaded hole 80, (FIG. 4) for accepting one tensioning nut 90 and a tensioning means 100, represented by a coil spring. A load bearing washer 110 is fixedly positioned in each frame tube 10. As the tensioning nut 90 is rotated, the tensioning means 100 is compressed or allowed to expand between the tensioning nut 90 and the washer 110. This results in a change in the axial force exerted onto the corner bracket which is directly transferred to the fabric 5.

FIG. 5 shows frame tube 10 in cross-section particularly indicating the attachment means 30 for the fabric 5. FIG. 6 shows further details of the fabric attachment means 30, specifically details of the slot 120. The fabric 5 is laid into the slot 120 and then locked into the slot by locking rod 150. Slot 120 has a protruding lip 140 against which locking rod 150 is forced as tension is applied to the fabric 5. In FIG. 6, locking rod 150 may be rotated clockwise and removed from slot 120, however with locking rod 150 positioned as shown, tension in the fabric tends to rotate locking rod 150 in the counterclockwise direction thereby further wedging fabric 5 within slot 120.

FIG. 6 further shows that locking rod 150 may have an adhesive surface 160 for adherence of the fabric edge 40. With the fabric edge 40 attached to the locking rod 150, it is possible to remove the screen with the locking rods while using the frame for another screen. Upon returning the original screen to the frame positioning of the fabric edges 40 in the slots 120 is accomplished more easily and with the proper tension then would be the case if the locking rods 150 were not at a specific location on the fabric edge 40.

In use, the fabric 5 is fitted into the four slots 120 in the frame tubes 10 of the stretching frame. The fabric 5 is then tensioned in one direction by rotating the externally threaded nuts 90 in opposite corresponding ends of two parallel frame tubes, equal amounts of rotation being applied to both nuts 90 in order to maintain parallelism between the other pair of parallel frame tubes 10. The fabric 5 is then tensioned in the alternate direction following a similar procedure in two corresponding, opposite and orthogonal nuts 90.

Figure 7:
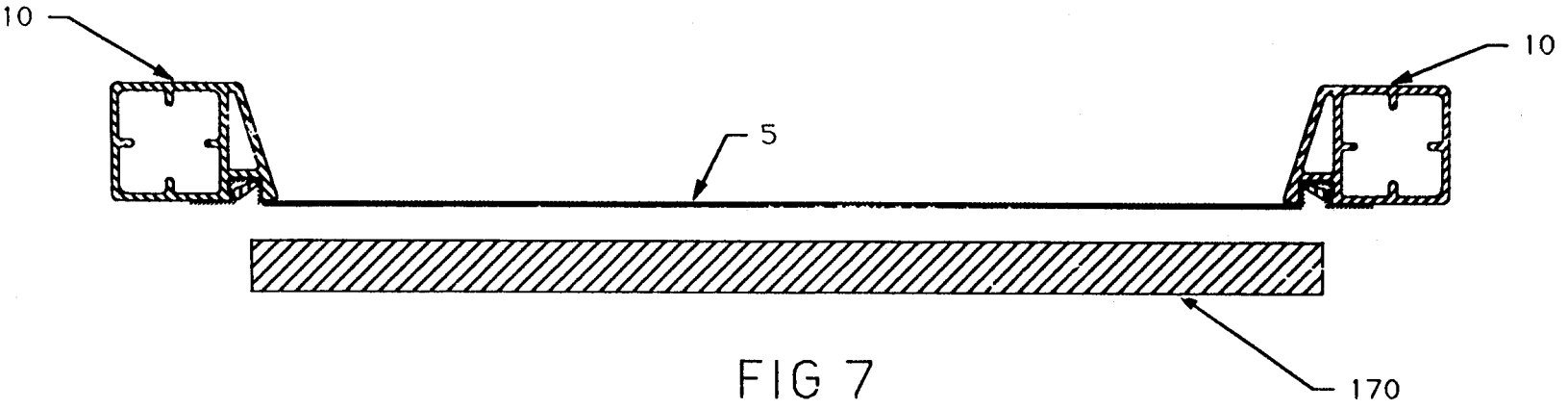
FIG. 7 is an end elevation showing a cross-sectional view of the frame and fabric as it would be held above a plate to be screened.
Figure 8:
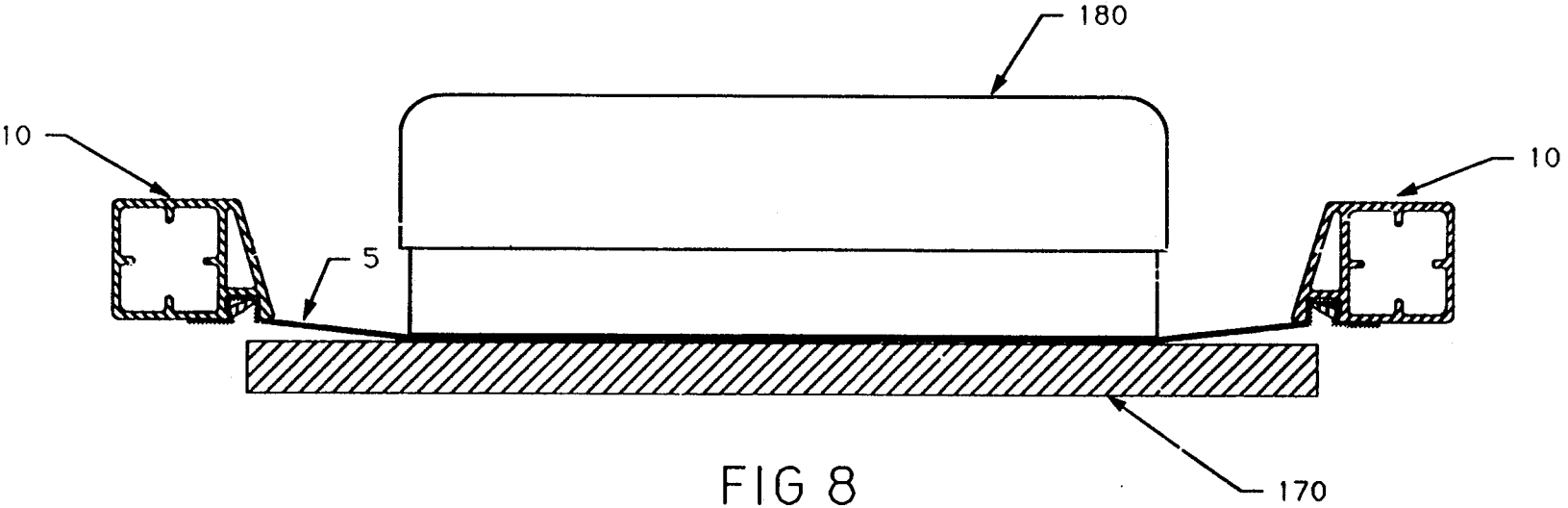
FIG. 8 is a view similar to FIG. 7 showing fabric deformation during the screening process.

FIG. 7 shows the stretching frame in position over a plate or workpiece 170 for screening. In FIG. 8 a squeegee 180 is shown being drawn across the fabric 5 in a silk-screening process. The fabric 5 and consequently the stencil thereon is forced to stretch into the extended position shown so that the fabric 5 touches plate 170 and the printed image tends to deform due to this stretching. Because the fabric 5 is attached to the frame continuously along all sides and the frame tubes 10 are spring loaded, uniform tension is maintained on the fabric. The opposing parallel frame tubes 10 move toward each other under pressure of the squeegee 180 so that printed image distortion is held to a minimum. Screen tension and accommodation of the stretching frame to forces normal to the fabric is dependent on the stiffness of the tensioning means 70 which may be selected to provide any desired stiffness.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. A screen stretching frame for stretching a fabric comprising:

a) means for tautly holding a screen fabric, comprising:

a plurality of straight frame tubes each having open ends, the tubes forming sides of the stretching frame, each of the frame tubes having a longitudinal axis and a means for attaching an edge of the fabric thereto, each edge lying approximately parallel to each said tube axis; and a plurality of corner brackets, each having a pair of tube insertion means, each one of the tube insertion means being slidably insertable into one of the open ends of one of the frame tubes and being slidable within the frame tube along the tube axis for both insertion and withdrawal therein; and b) means for adjustably altering tension on said screen fabric, said tension altering means coupled to said screen fabric holding means, said means for adjustably altering tension maintaining said screen fabric in a flat plane, said means for adjustably altering tension on said screen fabric allowing the screen stretching frame to compress and expand, comprising a plurality of means for tensioning, each tensioning means being supported within one of the frame tubes such that each one of the tensioning means forces one of the insertion means to be withdrawable from the frame tube along the tube axis;

the open ends of adjacent frame tubes each being interconnected by one corner bracket such that the frame tubes and the corner brackets complete a closed circuit, each edge of the fabric being attached to one attachment means, the fabric being stretched between generally opposing portions of the plurality of attachment means as the insertion means are withdrawn, the insertion means being urged to withdraw from each of the open ends of the frame tubes such that the fabric is placed in tension in an even manner across the fabric and such that the screen stretching frame maintains a generally constant and uniform tension upon said screen fabric when said screen fabric is deflected under the application of squeegee force to said screen fabric to apply a silk screen image to a substrate situated beneath said screen fabric.

2. A rectangular stretching frame for stretching a fabric, comprising:

two pairs of straight frame tubes having open ends, each pair forming the opposing sides of the rectangular stretching frame, each of the frame tubes defining a tube axis and having a means for attaching an edge of the fabric thereto, the fabric edge lying approximately parallel to the tube axis;

four rigid corner brackets, each of the corner brackets having a pair of mutually orthogonal, tube insertion means, each one of the tube insertion means being slidably insertable into one of the open ends of the frame tubes and being slidable within the frame tube along the tube axis for further insertion and withdrawal therein;

eight means for tensioning, each tensioning means being supported within one of the frame tubes such that the tensioning means urges the insertion means to withdraw from the frame tube along the tube axis;

the open ends of adjacent frame tubes each being interconnected by one corner bracket such that the four frame tubes and the four corner brackets complete the rectangular stretching frame, opposite edges of the fabric being attached to opposing pairs of frame tubes, the fabric being stretched between the two pairs of parallel frame tubes as the insertion means are withdrawn, the insertion means being urged to withdraw from each of the open ends of the frame tubes such that the fabric is placed in tension in a uniform manner;

each of said tensioning means allowing the stretching frame to compress and expand; whereby the stretching frame maintains a generally constant and uniform tension upon said fabric when said fabric is deflected under the application of squeegee force to said screen fabric to apply a silk screen image to a substrate situated beneath said screen fabric.

3. The frame of claim 2 wherein each of the tube insertion means has an axially aligned threaded hole, the tensioning means including an externally threaded nut for engaging the threaded hole, and a load bearing washer, the washer being held by the frame tube at a fixed position within the tube, the tensioning means being positioned between the nut and the washer such that as the nut is driven into the threaded hole, the tensioning means urges the tube insertion means to withdraw from the tube.

4. The frame of claim 2 wherein each of the attachment means includes a longitudinal slot in each of the frame tubes, and four non-circular locking rods, the rod fitting within the slot and free to rotate through an angle therein, such that at a first angular position, there is a clearance provided for the fabric between the rod and the sides of the slot, while at a second angular position the fabric is tightly clamped between at least one of the surfaces of the rod and at least one of the sides of the slot.

5. The frame of claim 2 wherein each locking rod has an adhesive surface such that each of the rods is adherable to the fabric edge, whereby the fabric and rods are removable as an assembly from the frame for storage and once removed are reinstalled into the frame as an assembly, the rods thereby providing proper fabric to frame alignment upon reinstallation.

6. The frame of claim 2 wherein both the insertion means and the frame tubes are angular in cross section such that the frame tubes are not rotatable with respect to the insertion means but provide mutual movement along the tube axis.

7. The frame of claim 2 wherein the tensioning means has a spring constant such that external forces on the fabric are absorbed by the tensioning means without appreciable deformation of the fabric and a stencil placed thereon.

* * * * *